US011123772B2

(12) United States Patent
Roos et al.

(10) Patent No.: US 11,123,772 B2
(45) Date of Patent: Sep. 21, 2021

(54) CONCENTRATING RARE EARTH ELEMENTS FROM COAL WASTE

(71) Applicant: Mineral Separation Technologies, Inc., Coal Center, PA (US)

(72) Inventors: Charles E. Roos, Nashville, TN (US); Edward J. Sommer, Jr., Nashville, TN (US); Charles D. Roos, New York, NY (US); Ricky Q. Honaker, Lexington, KY (US); Aaron Noble, Blacksburg, VA (US)

(73) Assignee: Mineral Separation Technologies, Inc., Washington, PA (US)

( * ) Notice: Subject to any disclaimer, the term of this patent is extended or adjusted under 35 U.S.C. 154(b) by 196 days.

(21) Appl. No.: 16/419,400

(22) Filed: May 22, 2019

(65) Prior Publication Data

US 2019/0358677 A1 Nov. 28, 2019

Related U.S. Application Data

(60) Provisional application No. 62/674,790, filed on May 22, 2018.

(51) Int. Cl.

| | |
|---|---|
| ***B07C 5/36*** | (2006.01) |
| ***B07C 5/34*** | (2006.01) |
| ***B07C 5/342*** | (2006.01) |

(52) U.S. Cl.

CPC ..... *B07C 5/3416* (2013.01); *B07C 5/342* (2013.01); *B07C 5/368* (2013.01)

(58) Field of Classification Search

CPC ..... B07C 5/3416; B07C 5/342; B07C 5/368

USPC ..... 209/577

See application file for complete search history.

(56) References Cited

U.S. PATENT DOCUMENTS

| | | | | |
|---|---|---|---|---|
| 3,449,567 | A * | 6/1969 | Olivier | G01N 23/10 378/51 |
| 4,090,074 | A | 5/1978 | Watt et al. | |
| 4,377,392 | A | 3/1983 | Massey et al. | |
| 4,486,894 | A | 12/1984 | Page et al. | |
| 5,738,224 | A | 4/1998 | Sommer, Jr. et al. | |
| 5,818,899 | A | 10/1998 | Connolly et al. | |
| RE36,537 | E | 2/2000 | Sommer, Jr. et al. | |
| 6,338,305 | B1 | 1/2002 | McHenry et al. | |
| 6,610,981 | B2 | 8/2003 | Sommer, Jr. | |
| 7,099,433 | B2 | 8/2006 | Sommer et al. | |

(Continued)

OTHER PUBLICATIONS

Rozelle, P.L., et al., "A Study on Removal of Rare Earth Elements from U.S. Coal Byproducts by Ion Exchange," Metallurgical and Materials Transactions E, Mar. 2016, vol. 3(1):6-17.

*Primary Examiner* — Terrell H Matthews

(74) *Attorney, Agent, or Firm* — Frost Brown Todd LLC

(57) ABSTRACT

Differences in x-ray absorption coefficients and ash content are used to process coal waste and concentrate rare earth elements (REE) found in coal seams. A method for processing the coal waste includes receiving, by a detector, at least one collimated x-ray beam from an x-ray source that has been passed through a sample of coal waste; determining measurements of at least one x-ray absorption characteristic of the sample based on the received at least one collimated x-ray beam; and identifying a first region in the sample having a concentration of rare earth elements based on the measured x-ray absorption characteristic.

18 Claims, 14 Drawing Sheets

(56) References Cited

U.S. PATENT DOCUMENTS

| | | | | |
|---|---|---|---|---|
| 7,200,200 | B2 | 4/2007 | Laurila et al. | |
| 7,542,873 | B2 | 6/2009 | Vince et al. | |
| 7,564,943 | B2 | 7/2009 | Sommer, Jr. et al. | |
| 7,664,225 | B2 | 2/2010 | Klein | |
| 7,763,820 | B1 * | 7/2010 | Sommer, Jr. | B07C 5/346 209/576 |
| 7,848,484 | B2 | 12/2010 | Sommer, Jr. et al. | |
| 8,144,831 | B2 | 3/2012 | Sommer, Jr. et al. | |
| 8,610,019 | B2 | 12/2013 | Roos et al. | |
| 8,853,584 | B2 | 10/2014 | Roos et al. | |
| 9,114,433 | B2 | 8/2015 | Roos et al. | |
| 9,126,236 | B2 | 9/2015 | Roos et al. | |
| 2001/0033636 | A1 * | 10/2001 | Hartick | G01N 23/20 378/88 |
| 2010/0219109 | A1 * | 9/2010 | Roos | B07C 5/3416 209/3.1 |
| 2013/0079918 | A1 * | 3/2013 | Spencer | G01N 23/02 700/223 |
| 2013/0184853 | A1 * | 7/2013 | Roos | B07C 5/363 700/214 |
| 2016/0107197 | A1 * | 4/2016 | Hartmann | B07C 5/3416 241/24.12 |

* cited by examiner

| density | 5.0 g/cc | 1.2 g/cc | 2.6 g/cc |
|---|---|---|---|
| Energy (kev) | FeS (Coefficient μ ($cm^{-1}$)) | Coal (Coefficient μ ($cm^{-1}$)) | $SiO_2$ (Coefficient μ ($cm^{-1}$)) |
| 6.00 | 763.20 | 7.730 | 227.10 |
| 8.00 | 963.70 | 3.160 | 99.200 |
| 10.00 | 530.70 | 1.680 | 51.790 |
| 15.00 | 174.17 | 0.570 | 15.830 |
| 20.00 | 77.67 | 0.312 | 6.930 |
| 30.00 | 24.64 | 0.181 | 2.360 |
| 40.00 | 11.06 | 0.147 | 1.250 |
| 50.00 | 6.02 | 0.132 | 0.847 |
| 60.00 | 3.87 | 0.124 | 0.666 |
| 80.00 | 2.08 | 0.114 | 0.547 |
| 100.00 | 1.41 | 0.107 | 0.440 |

Figure 9

| Element | Atomic Number | Density (g/cm$^3$) | Energy (MeV) | Coefficient ($\mu/\rho$) |
|---|---|---|---|---|
| Lanthanum | 57 | 0.41035 | 1.0E-02 | 1.967E+02 |
| Cerium | 58 | 0.41395 | 1.0E-02 | 2.082E+02 |
| Praseodymium | 59 | 0.41871 | 1.0E-02 | 2.209E+02 |
| Neodymium | 60 | 0.41597 | 1.0E-02 | 2.300E+02 |
| Promethium | 61 | 0.42094 | 1.0E-02 | 2.440E+02 |
| Samarium | 62 | 0.41234 | 1.0E-02 | 2.499E+02 |
| Europium | 63 | 0.41457 | 1.0E-02 | 2.629E+02 |
| Gadolinium | 64 | 0.40699 | 1.0E-02 | 2.693E+02 |
| Terbium | 65 | 0.40900 | 1.0E-02 | 2.815E+02 |
| Dysprosium | 66 | 0.40615 | 1.0E-02 | 2.902E+02 |
| Holmium | 67 | 0.40623 | 1.0E-02 | 3.012E+02 |
| Erbium | 68 | 0.40655 | 1.0E-02 | 3.129E+02 |
| Thulium | 69 | 0.40844 | 1.0E-02 | 2.830E+02 |
| Ytterbium | 70 | 0.40453 | 1.0E-02 | 2.893E+02 |
| Lutetium | 71 | 0.40579 | 1.0E-02 | 2.211E+02 |
| Scandium | 21 | 0.46712 | 1.0E-02 | 9.952E+01 |
| Yttrium | 39 | 0.43867 | 1.0E-02 | 6.871E+01 |
| Carbon | 6 | 0.49954 | 1.0E-02 | 2.373E+00 |

Figure 9A

CONCENTRATING RARE EARTH ELEMENTS FROM COAL WASTE

REFERENCE TO RELATED APPLICATIONS

This application is a nonprovisional of and claims priority to U.S. Provisional Patent Application No. 62/674,790, filed on May 22, 2018, entitled "Concentrating Rare Earth Elements from Coal Waste," the disclosure of which is hereby incorporated by reference in its entirety.

BACKGROUND

Many of the coal seams in the U.S. contain rare earth elements (REE) that may be used in industries involved in energy production, high-tech manufacturing, and security. Typically, REE includes lanthanides such as lanthanum, cerium, praseodymium, neodymium, promethium, samarium, europium, gadolinium, terbium, dysprosium, holmium, erbium, thulium, ytterbium, and lutetium. Scandium and yttrium are also commonly included as REE. Because of its geochemical properties, REE is typically dispersed in the Earth's crust and not often found concentrated. As a result, the local concentration of these elements in the natural environment is typically low, which makes REE vulnerable to shortages and the development of cost-effective extraction systems challenging.

Because REE may often be found with aluminum silicates in high-ash coal, it may be desirable to supply REE as byproducts from existing coal producing operations that separate coal from waste. A common technology for separating coal from coal waste is heavy media separation. In heavy media separation, a mix of coal and rock is introduced into a mix of water and magnetite to increase the density of the water. In this heavy solution, the dense rocks sink, but the less-dense coal floats. While this could be effective for removing coal from rocks rich in REE, it cannot separate rocks with REE from rocks without REE. The densities of these rocks are too high and too similar for heavy media separation.

Another technology for separating coal from coal waste is dual-energy x-ray (DXRT) separation. In DXRT separation, a sensor flashes pieces of coal and rock with x-rays and measures the x-ray absorption at two different energies. The x-ray absorption is a characteristic property of the atomic weight of the particle. Coal tends to be low in atomic weight and rocks tend to be high in atomic weight. For coal sorting, air jets in the DXRT separator then separate the high-atomic-weight pieces from the low-atomic-weight pieces. A DXRT separator built for coal sorting may also be effective for removing coal from rocks rich in REE producing fractions having enhanced concentrations of REE. Thus, it may be desirable to use x-ray absorption characteristics to sort fractions of coal streams having greater concentrations of REE.

Examples of other coal sorting devices and related concepts are disclosed in U.S. Pat. No. 8,610,019, entitled "Methods for Sorting Materials," issued Dec. 17, 2013; U.S. Pat. No. 8,853,584, entitled "Methods for Sorting Materials," issued Oct. 7, 2014; U.S. Pat. No. 9,114,433, entitled "Multi-fractional Coal Sorter and Method of Use Thereof," issued Aug. 25, 2015; U.S. Pat. No. 9,126,236, entitled "Methods for Sorting Materials," issued Sep. 8, 2015, U.S. Pat. No. 8,144,831, entitled "Method and Apparatus for Sorting Materials According to Relative Composition," issued Mar. 27, 2012; U.S. Pat. No. 7,848,484, entitled "Method and Apparatus for Sorting Materials According to Relative Composition," issued Dec. 7, 2010; U.S. Pat. No. 7,564,943, entitled "Method and Apparatus for Sorting Materials According to Relative Composition," issued Jul. 21, 2009; U.S. Pat. No. 7,099,433, entitled "Method and Apparatus for Sorting Materials According to Relative Composition," issued Aug. 29, 2006; U.S. Pat. RE36537, entitled "Method and Apparatus for Sorting Materials Using Electromagnetic Sensing," issued Feb. 1, 2000; U.S. Pat. No. 5,738,224, entitled "Method and Apparatus for the Separation of Materials Using Penetrating Electromagnetic Radiation," issued Apr. 14, 1998; U.S. Pat. No. 7,664,225, entitled "Process and Device for the Fast or On-line Determination of the Components of a Two-Component or Multi-Component System," issued Feb. 16, 2010; U.S. Pat. No. 6,338,305, entitled "On-line Remediation of High Sulfur Coal and Control of Coal-Fired Power Plant Feedstock," issued Jan. 15, 2002; U.S. Pat. No. 7,542,873, entitled "Method and Apparatus for Determining Particle Parameter and Processor Performance in a Coal and Mineral Processing System," issued Jun. 2, 2009; U.S. Pat. No. 7,200,200, entitled "X-Ray Fluorescence Measuring System and Methods for Trace Elements," issued Apr. 3, 2007; U.S. Pat. No. 5,818,899, entitled "X-Ray Fluorescence Analysis of Pulverized Coal," issued Oct. 6, 1998; U.S. Pat. No. 4,486,894, entitled "Method and Apparatus for Sensing the Ash Content of Coal," issued Dec. 4, 1984; U.S. Pat. No. 4,090,074, entitled "Analysis of Coal," issued May 16, 1978; U.S. Pat. No. 4,377,392, entitled "Coal Composition," issued Mar. 22, 1983; U.S. Pat. No. 8,610,019, entitled "Methods for Sorting Materials," issued Dec. 17, 2013; and U.S. Pat. No. 6,610,981, entitled "Method and Apparatus for Near-Infrared Sorting of Recycled Plastic Waste," issued Aug. 26, 2003, each of which is hereby incorporated by reference in its entirety.

While a variety of devices and methods for processing coal waste have been made and used, it is believed that no one prior to the inventor(s) has made or used an invention as described herein.

SUMMARY

Devices and methods are disclosed for processing high-ash coal waste to provide material having a concentrated REE. For instance, selection of coal waste with high ash content, but a lower absorption of x-rays, can increase the REE content, such as by an average of 1.5 times. Accordingly, an x-ray system is disclosed to provide concentrated REE from high-ash waste coal by modifying analysis programs and sorting parameters to reduce the rock in coal and provide REE ore from the coal waste. The high-ash waste coal is thereby processed using differences in x-ray absorptions characteristics and/or coefficients to concentrate the portion with REE.

In one embodiment, a method of sorting materials may comprise the steps of: A method of sorting materials, comprising the steps of: providing a sample of coal waste; receiving at least one collimated x-ray beam from an x-ray source that has been passed through the sample by a detector; determining measurements of at least one x-ray absorption characteristic of the sample based on the received at least one collimated x-ray beam; and identifying a first region in the sample having a concentration of rare earth elements based on the measured x-ray absorption characteristic. Identifying the first region in the sample having a concentration of rare earth elements may comprise determining whether the measured x-ray absorption characteristic is both greater than an x-ray absorption characteristic of a coal material and less than an x-ray absorption characteristic of a rock material.

In another embodiment, a method of sorting materials may comprise the steps of: providing a sample of coal waste; receiving by at least one detector at least one collimated x-ray beam from an x-ray source that has been passed through the sample; measuring at least one x-ray absorption characteristic of the sample based on the received at least one collimated x-ray beam; identifying a first region and a second region in the sample having a concentration of rare earth elements based on the measured x-ray absorption characteristic, wherein the first region is larger than the second region; and sorting the first region from the sample by a first ejector and sorting the second region from the sample by a second ejector.

In another embodiment, a multi-fractional coal sorting device may comprise: an x-ray source in a fixed position; a first collimator attached to the x-ray source; a first x-ray detector positioned to receive x-rays collimated by the first collimator, wherein the first x-ray detector is configured to measure at least one x-ray absorption characteristic of a sample from the received x-rays collimated by the first collimator; a first microprocessor operationally connected to the first x-ray detector, wherein the first microprocessor is configured to identify a first region in the sample having a concentration of rare earth elements based on the measured x-ray absorption characteristic; and a first sized ejector operationally connected to the first microprocessor and configured to eject the first region in the sample having a concentration of rare earth elements.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

FIG. 9 is a table showing the linear absorption coefficients for iron pyrite (FeS), coal, and silicon dioxide ($SiO_2$) over a range of x-ray energies for use with the sorting devices of FIGS. 1-8;

FIG. 9A is a table showing the mass attenuation coefficients for REE for use with the sorting devices of FIGS. 1-8;

Figure 1:
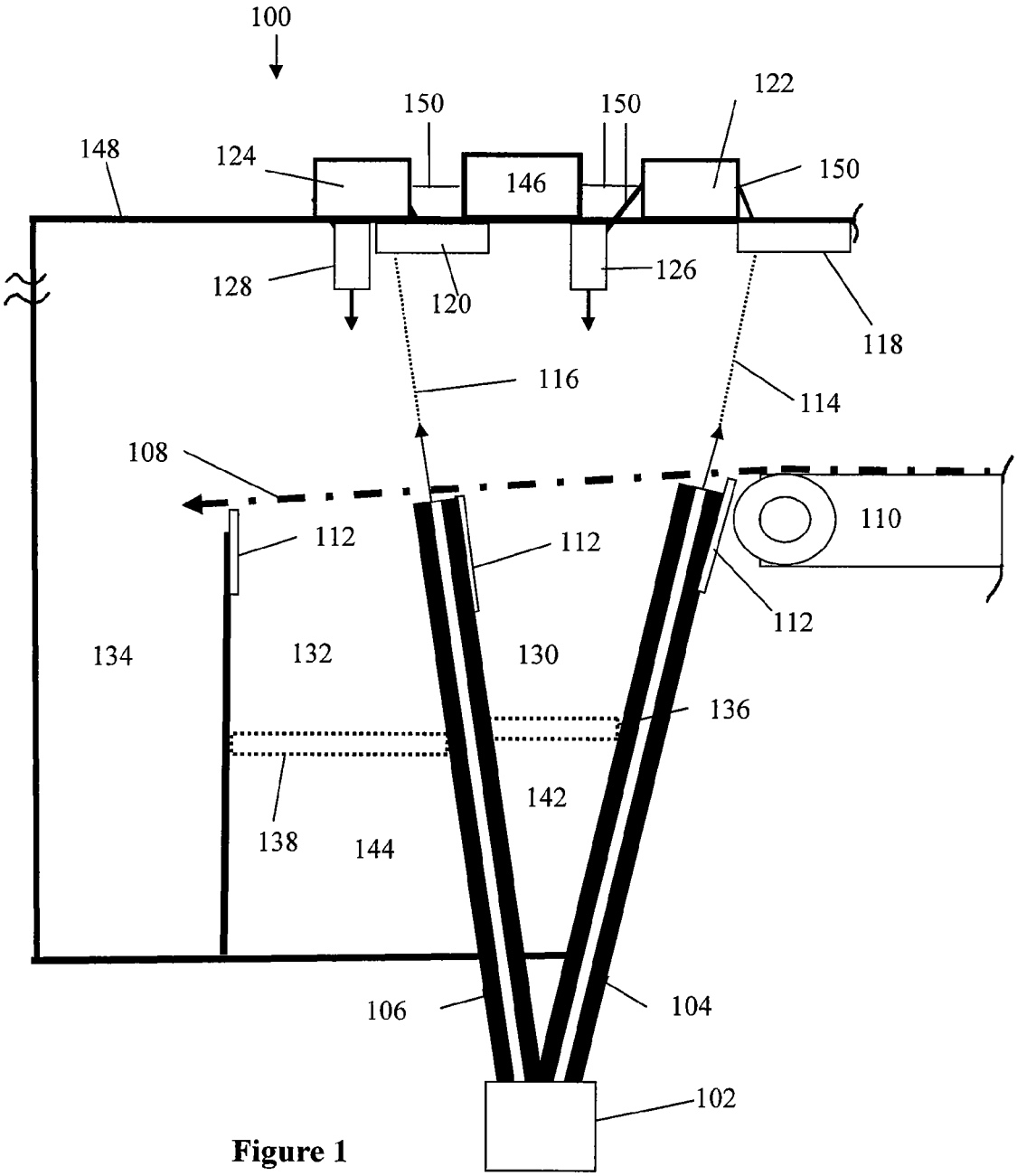
FIG. 1 is a side elevational view of an exemplary coal sorting device for processing concentrated REE.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

The exemplary devices and methods disclosed use x-rays for identifying materials to be sorted from a feedstream of mixed materials, such as coal waste materials, to produce sorted fractions having greater concentrations of REE than other fractions. The device and methods disclose the use of specific x-ray energies to detect samples having regions of different sizes so that large and small regions of coal waste having higher concentrations of REE may be effectively sorted away from other regions of the coal waste stream having lower concentrations of REE. A sample may include providing a run of mine ore from a coal mine, a coal waste stream that has already been subjected to some cleaning method or procedure, and/or any ore material containing REE. A device disclosed herein includes an x-ray source and collimators so that x-rays are collimated into a narrow fan, which is directed at x-ray detectors. Each collimated x-ray beam hits a separate detector that can control separate air jets. This permits a strong air blast from a large air ejector to remove large regions and a much smaller air blast from a small ejector to remove small regions. Accordingly, the device may receive collimated x-ray beams in order to determine x-ray absorption measurements of a sample, identify small and large regions of REE in the sample, and remove those small and large regions from the sample by the use of ejectors having different and appropriate force. These sorted fractions of greater concentrations of REE can thereby provide a valuable enriched feedstream of materials for a downstream REE recovery process.

I. EXEMPLARY X-RAY DEVICES FOR SORTING REE IN COAL WASTE MATERIALS

By way of background, x-ray absorption in a material is a function of the density and atomic number (Z) of the material and it is also a function of the energy of the incident x-rays. A given piece of material may absorb x-rays to differing degrees depending upon the energy of the incident x-rays. Materials of differing atomic numbers may absorb x-rays differently. For example, materials having a higher atomic number may absorb x-rays much more readily than materials having a lower atomic number. Also, the absorption profile of a given material over a range of x-ray energies may be different than the absorption profile of another material over that same range of energies. X-ray transmission through a material is given by the equation $N(t)=N0\exp(-\eta\rho t)$, where N(t) is the number of photons remaining from an initial NO photons after traveling through thickness t in a material of density ρ. The mass attenuation coefficient 11 is a property of the given material and has a dependence upon photon energy. The value ηρ is referred to as the linear absorption coefficient (μ) for a given material. Values of the coefficient have been established by researchers to high accuracy for most materials and these values are dependent upon the energy of incident x-ray photons. Values of μ/ρ (=1) for most elements can be found at the National Institute of Standards and Technology (NIST) internet website. The lists of values are extensive covering all stable elements for various values of photon energy (for example, a kilo electron volt, abbreviated as KeV, and/or a mega electron volt, abbreviated as MeV). The value of ρ for a given material is simply its density in gram/$cm^3$ and can be found in many textbooks and also at the NIST website. The ratio N(t)/N0 is the transmittance of photons through a thickness t of material and is often given as a percentage, i.e. the percentage of photons transmitted through the material.

Referring to FIG. 1, a schematic diagram is shown of an exemplary embodiment of a coal sorting device 100 for providing a stream of materials having concentrated REE. Shown therein is a conveyor belt 110 for transporting a coal waste stream 108 bearing REE material into a path between an x-ray source 102 attached to a first and second collimator 104 and 106, and first and second x-ray detectors 118 and 120 to receive the collimated x-rays. The collimated narrow x-ray beam fans perpendicular to and under the sample stream 108.

When referred to herein, x-ray source 102, means a source of x-rays, such as an x-ray tube, or the like, as known to those in the industry. In the illustrated embodiment, an x-ray source 102, first collimator 104, and second collimator 106 are located under a sample stream 108 flying off conveyor belt 110 that clears splitter plates 112. The sample stream 108 may also be referred to as a mineral or waste coal stream. Said collimators produce x-ray fans 114 and 116 that strike a first x-ray detector 118 and a second x-ray detector 120, respectively, which measure the absorption by the sample stream 108. Each x-ray detector 118 and 120 send signals to the first microprocessor 122 and second microprocessor 124, respectively, which communicate with and control the first sized ejector 126 and second sized ejector 128, respectively, that deflect selected objects from the sample stream 108 into bins 130 and 132.

A structural support 148 is used to mount detectors 118 and 120, ejectors 126 and 128, microprocessors 122 and 124, as well as other equipment, such as a computer 146, as needed in a given embodiment. Also shown are communication connections 150, such as data cables, and the like, as known to those of ordinary skill in the art, for the necessary electrical, data and information transfer between the various components. Throughout this application, it is understood that the necessary electrical, data and information transfer connections are in place between the various components whether or not such operational connections are shown in the figures. Further, given the schematic nature of the figures, such operational connections are understood to be represented.

In this embodiment, the first microprocessor 122 selects ejection for high-REE regions in the sample stream 108, and the first sized ejector 126 deflects the selected region into bin 130 where it strikes a first screen 136 having openings 140 that allow undersized items to pass into bin 142 where they can be returned to the conveyor 110. To identify a high-REE region, first microprocessor 122 may distinguish pieces in the sample stream 108 that tend to have REE from pieces in the sample stream 108 that tend not have REE. REE regions are generally found in carbonated shale and typically have a specific gravity of about 1.8 to about 2.0. REE regions may also be typically found among interseam rock of some coal seams. Because REE is typically found in carbonated shale, the high-REE region tends to present to the sorter 100 as high-BTU silicon, or a carbon-silicon mix, having middle-Z properties. The first microprocessor 122 may thereby identify regions in the sample stream 108 having middle-Z properties, which may typically include REE, from regions of coal having low-Z properties and from regions of rocks having high-Z properties. Once the first microprocessor 122 identifies the region of REE, the first microprocessor 122 can actuate the first sized ejector 126 to deflect the selected region away from the sample stream 108 and into bin 130.

It is understood that the first sized ejector 126 will deflect a mixture of rock and coal fines. Impacts of the rock on these screens cause vibrations that facilitate the separation of the fines from the ejected rock. The second collimated x-ray beam 116 strikes an x-ray detector 120, which detects x-ray absorption by the smaller regions having REE in the sample stream 108, and the second microprocessor 124 sends a signal to the second sized ejector 128 in order to deflect the smaller region into bin 132 and onto a screen 138 that has openings 140 sized to recover fine coal. The fine coal is collected in bin 144 and can be transferred to sorted coal bin 134. The data from the microprocessors 122 and 124 is analyzed by the computer 146 and is used to adjust and measure the performance of the device 100.

Still referring to FIG. 1, as the sample stream 108 passes between the x-ray source 102 and the x-ray detector 118, the sample is irradiated. The x-ray detector 118 is operationally connected by connection 150 to a first microprocessor 122, which directs first sized ejector 126 to send regions selected by first microprocessor 122 to bin 130. As used herein, "microprocessor" refers to a computer or the like that is programmed and configured to serve the stated function. Material that is not ejected is collected in bin 134. As previously disclosed herein, the microprocessor uses software or other means to perform the steps indicated herein.

Regarding the manufacture and use of collimators, methods are well known in the industry for making suitable collimators as described herein. An example of a material which a collimator is made of is steel, having a thickness of about 5 mm with an opening of about a quarter inch through which the x-rays pass. In other embodiments, collimators may be manufactured of lead or brass and sized as needed. One of ordinary skill in the art is familiar with such collimators. Use of a collimator with x-rays is beneficial because they reduce scattered x-rays. In the embodiments shown herein, the collimators are attached to the x-ray source 102 by bolts and also attach to framework or supports (not shown) of the collection bins. Alternatively, the collimators may be attached to the housing of x-ray source 102 by any means known to those of skill in the art.

A difference in force produced exists between the first sized ejector 126 and the second sized ejector 128. For example, the air blast required to deflect a large region is much greater than the air blast needed to remove smaller objects. If the same air blast is used for all detected region sizes, there is too much loss of product. Accordingly, smaller sized air ejectors in an air ejector array are spaced closer together than are larger ejectors, and they have an air blast profile that is smaller in area and smaller in force than the air blast profile from the larger ejectors. Larger sized regions are ejected using the larger ejectors, and smaller sized regions are ejected using the smaller ejectors.

After a decision is made that a particular region is present and should be ejected, the next determination regards what area needs to be ejected with the appropriate large or small ejectors selected to eject the region. Some x-ray sensing devices have a capacity of 32 linear pixels per inch. Other x-ray sensing devices have a capacity of 64 linear pixels per inch. The ejection area size may be set based upon a required number of pixels detecting a contaminant. For example, if a device having 32 linear pixels per inch is in use which are read 32 times as the sample travels one inch in passing between the x-ray source 102 and the detector, and it is desired to eject areas of one square inch, then it could be required that 1024 contiguous pixels would need to examine a region in order for the air ejector to be triggered to take action. The number of contiguous pixel readings having reduced x-ray transmissions required to initiate a blast of air for ejection corresponds with the minimum size of the ejected region. The required number of pixels is an adjustable parameter of the method. With the example above, one of ordinary skill in the art may adjust the parameter to their specific needs. Accordingly, if economic value is provided by removing smaller contaminant inclusions, then the methods disclosed herein may be used. In still other embodiments, the percentage transmission information is saved by the machine and used to normalize the voltage output of each pixel in the x-ray detector array. The number of pixels and the threshold percentage transmission are adjustable parameters that can be set manually or automatically in the x-ray measuring device.

Figure 2:
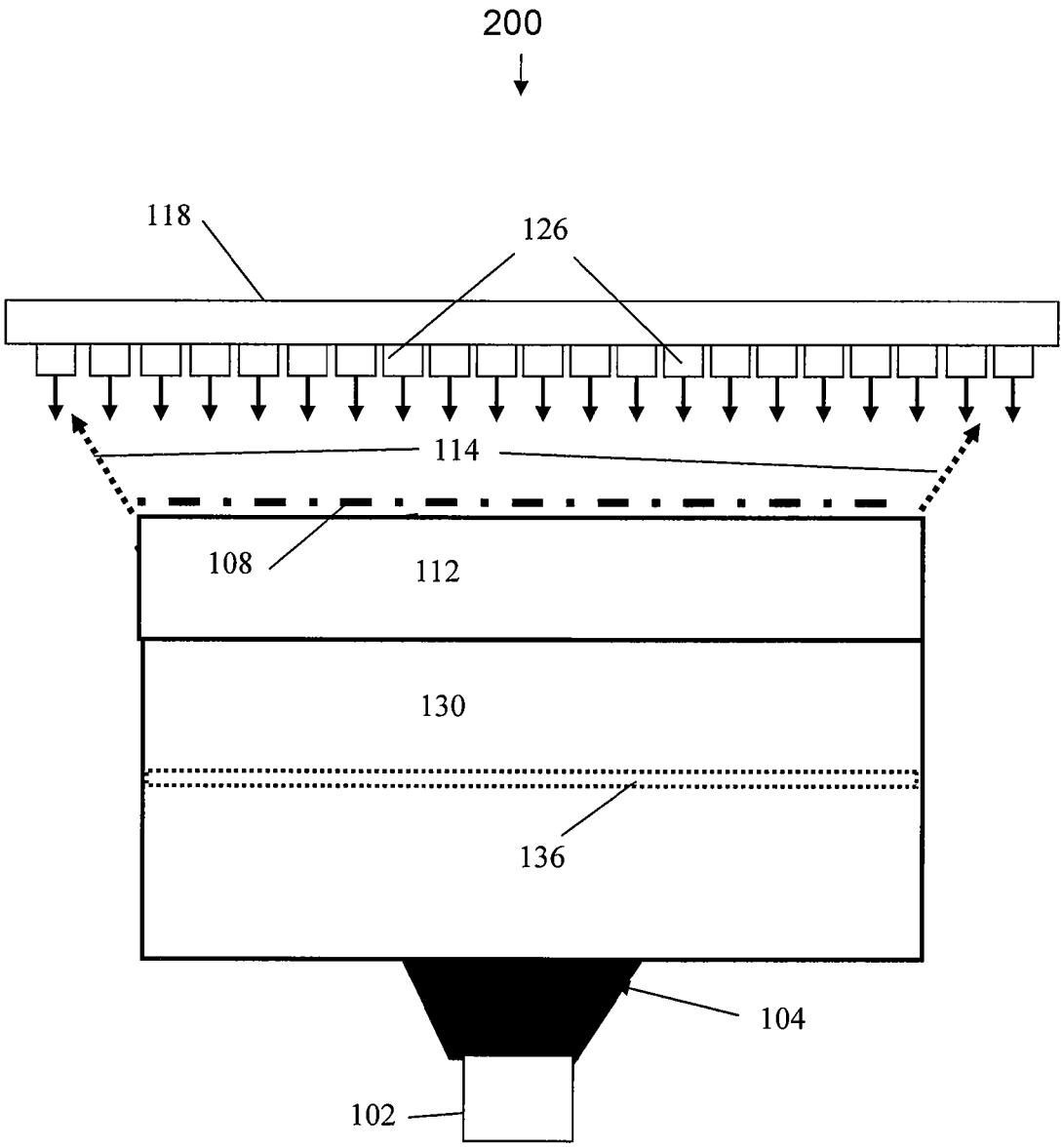
FIG. 2 is a front view of an alternative exemplary coal sorting device for processing concentrated REE.

Referring now to FIG. 2, an exemplary coal sorting device 200 is shown having an x-ray source 102 and collimator 104 located under a sample stream 108 that clears splitter plate 112. The collimated x-ray fan 114 strikes the first x-ray detectors 118, which detect the absorption by the larger regions in the sample stream 108. The first x-ray detector 118 sends a signal to the first-sized ejectors 126 that deflect the regions into bin 130 and onto a screen 136 (shown in phantom lines) with openings 140 sized to recover small sizes.

Figure 3:
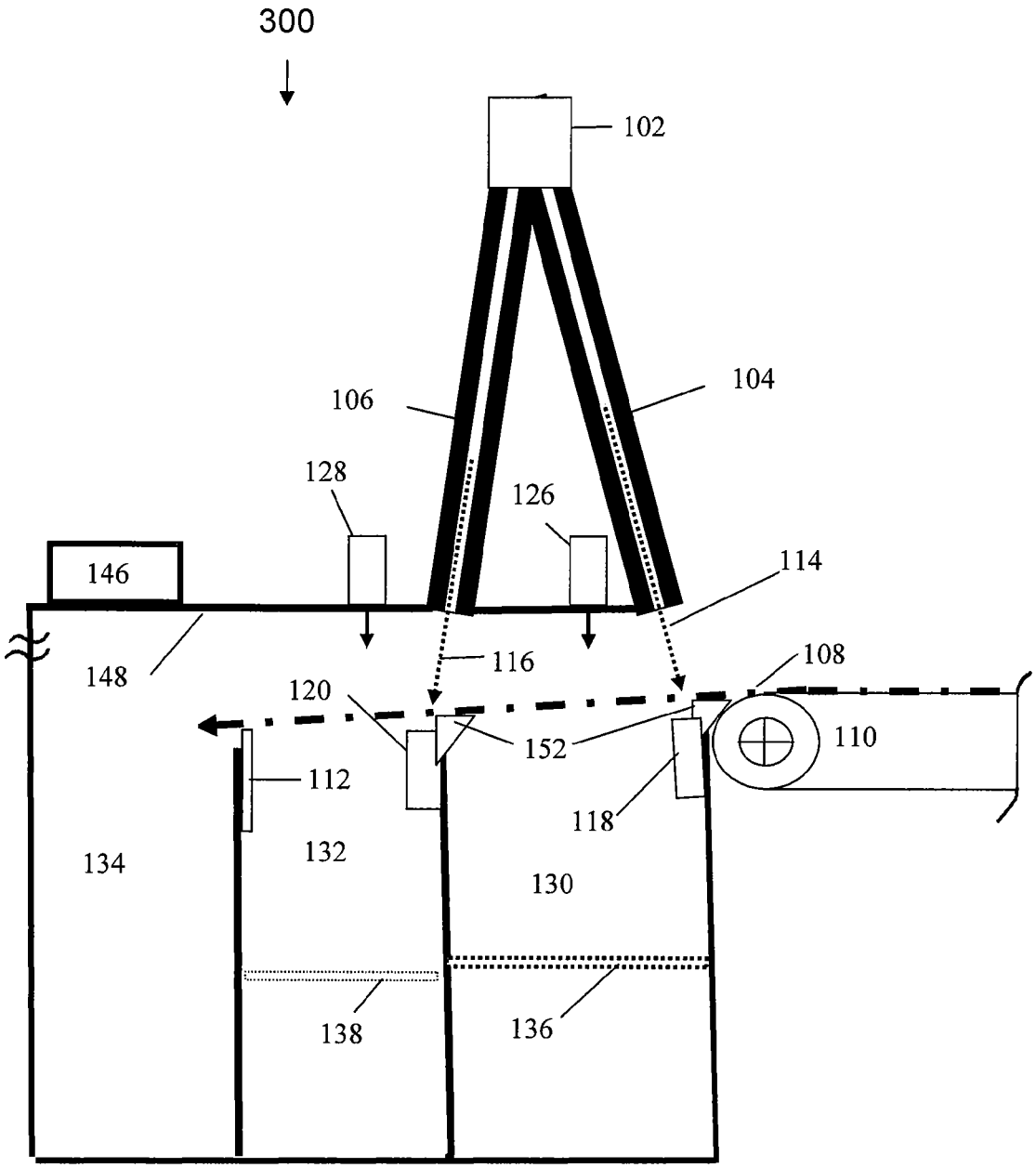
FIG. 3 is a side elevational view of an alternative exemplary coal sorting device for processing concentrated REE.

FIG. 3 shows an alternative exemplary coal sorting device 300 in which the x-ray source 102, first collimator 104, and second collimator 106 are located above the sample stream 108 that flies off a conveyor 110. The first collimated x-ray fan 114 strikes the first x-ray detector 118 which detects the absorption by the larger regions in the sample stream 108. The first x-ray detector 118 sends a signal to the first sized ejector 126 for large regions that deflects the regions into bin 130 and onto a first screen 136 having openings 140 sized to recover small sizes. The second collimated x-ray fan 116 strikes a second x-ray detector 120 which detects the absorption by the smaller regions in the sample stream 108 and sends a signal to the second sized ejector 128 for small regions that deflects said rocks into bin 132 and onto a second screen 138 with openings 140 sized to recover fine coal. The sample stream 108 passes over the splitter plate 112 and is collected in bin 134. Also shown is computer 146, which is operationally connected to the microprocessors 122 and 124 (not shown) for recording data and performing other functions as disclosed herein. The first microprocessor 122 of the first x-ray detector 118 is located where the detector 118 is shown. Also, the second microprocessor 124 of the second x-ray detector 120 is located where the detector 120 is shown. Electrical and data communication connections that exist between the computer 146, detectors 118 and 120 and ejectors 126 and 128 are not shown.

Figure 11:
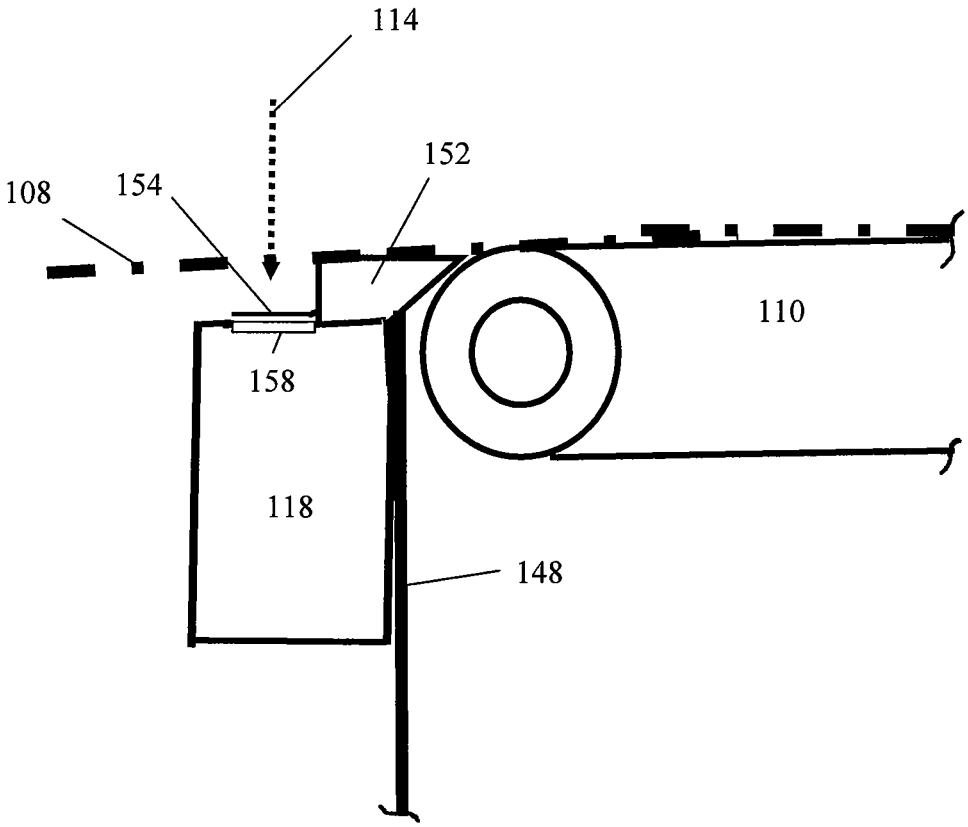
FIG. 11 is enlarged side elevational view of a deflection plate for use with the sorting devices of FIGS. 1-8.

The device 300 further includes a deflection plate 152, shown in detail in FIG. 11, to protect the detector window 158 of the x-ray detector 118 from the coal waste stream 108. In certain embodiments, the deflection plate 152 is a steel plate with a heat-treated diamond coating and a diamond-coated plastic window. The use of vapor-deposited carbon to provide a diamond coating is well known to those skilled in the art. This coating is abrasion resistant and has x-ray absorption comparable to coal. In other embodiments, the deflection plate 152 may be constructed of material suitable for the function disclosed herein, such as tool steel or ceramics.

The deflection plate 152 permits the sensitive portions of the x-ray detector 118 to withstand the bombardment by portions of the sample stream 108. It also will allow placement of the detector 118 on the edge of the coal waste stream 108 for a reduction in required x-ray power and an increase in the signal-to-noise levels. In some embodiments, the diamond-coated deflection plate 152 includes a bar, also called a body, that is bolted to the frame of the device 300 and a diamond-coated plastic film or diamond-coated metal foil that lies over an x-ray detector window 158, as shown in FIG. 11. The body of the deflection plate 152 acts to prevent an item in the sample stream 108 from contacting a detector, such as detector 118. In some embodiments, a flat body shape in alignment with the flow of the sample stream 108 is desired. The deflection plate 152 thereby functions to protect the x-ray detectors 118 and 120, electronics, or other equipment that may be positioned under, or beneath, the sample stream 108. That is, the deflection plate 152 establishes the lower boundary of the sample stream 108, so that items under that lower boundary are not inadvertently struck by something in the sample stream 108. Accordingly, it protects the window 158 while allowing x-rays 114 to pass through the diamond coated plastic window 154 portion of the deflection plate 152 and window 158 to interact with the detector 118.

As discussed above, the larger regions of REE are thereby first removed from the sample stream 108, then a second set of x-ray detectors 120 control the second-sized ejectors 128 to remove the smaller regions of REE. FIG. 2 shows the x-ray fan from an x-ray tube 102 mounted under the sample stream 108 from a high-speed conveyor 110. FIG. 3 shows an alternative arrangement in which the x-ray tube 102 is mounted above the sample stream 108.

Figure 4:
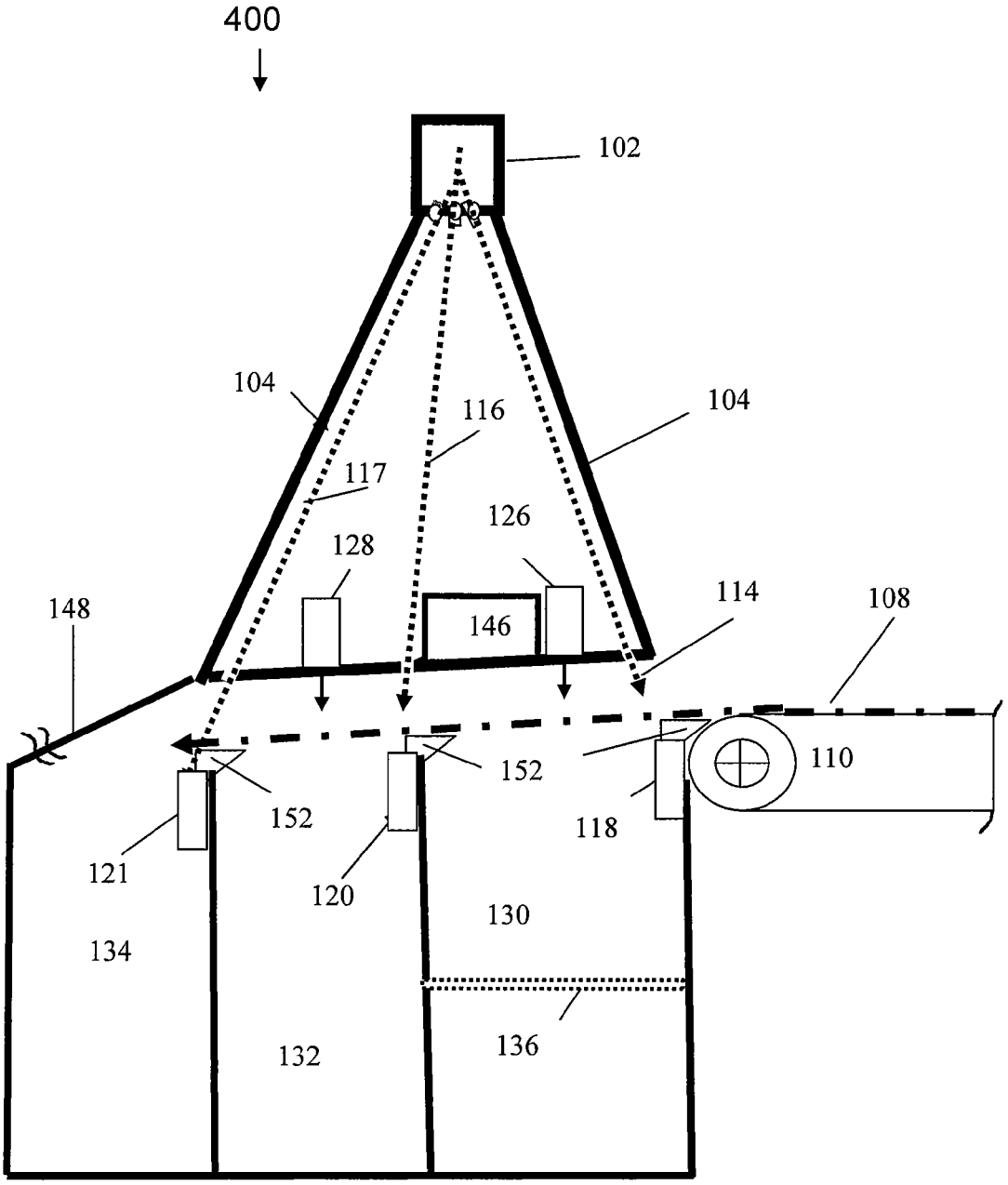
FIG. 4 is a side elevational view of an alternative exemplary coal sorting device for processing concentrated REE.

Referring now to FIG. 4, another exemplary coal sorting device 400 is shown comprising a conveyor belt 110 for transporting waste coal into a path between an x-ray source 102 attached to first collimator 104 located above the sample stream 108 and first, second and third x-ray detectors 118, 120, 121 located below the sample stream 108 to receive the collimated x-rays. Also shown are the two sizes of ejectors 126, 128 for separating the waste coal into the areas shown. The computer 146 uses the data from the three detectors to measure sorting efficiency. From the single collimator 104, there are multiple collimated narrow x-ray beam fans 114, 116, 117 perpendicular and above the sample stream 108.

Accordingly, the device 400 of FIG. 4 includes an x-ray source 102 and a single collimator 104 to produce the collimated x-ray fans 114, 116, 117, which are located over a sample stream 108 flying off conveyor 110. In some embodiments, the collimator 104 is a single closed structure, except for the openings which allow passage of x-ray beams. With such a construction, other items, such as a computer 146, may be placed inside of the structure. The collimated x-ray fans 114, 116, 117 strike the x-ray detectors 118, 120, 121, respectively, which detect the absorption by items in the sample stream 108. The x-ray detectors 118, 120, 121 send measurements to microprocessors 122, 124, 125. Those microprocessors 122, 124, 125 are at the same location in schematic FIG. 4 as their corresponding detectors 118, 120, 121, respectively.

Figure 12:
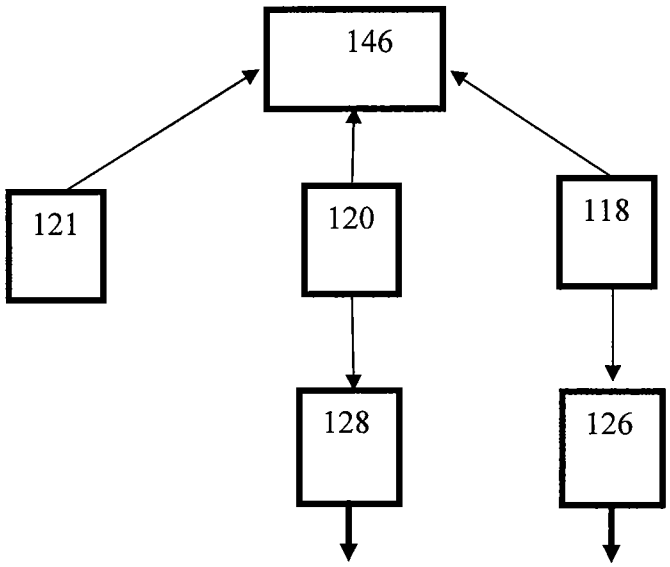
FIG. 12 is a schematic diagram showing connections between x-ray detectors, ejectors, and computers of the sorting devices of FIGS. 1-8.

FIG. 12 is a schematic diagram showing the connections between the different x-ray detectors, ejectors and the computer shown in FIG. 4. FIG. 12 shows the data flow from x-ray detectors 118, 120 and 121 to the computer 146 shown in FIG. 4. The computer 146 collects, processes, and stores the x-ray data. Detector 120 triggers ejector 128 and detector 118 triggers ejector 126 to fire on selected signals. The computer 146 measures the size distribution and amount of the material ejected into bin 130 using the difference in the signals from detectors 118 and 120. The computer 146 also detects the ejection efficiency with the ratio of ejected items and the number of the triggers to ejector 126. The computer 146 also uses the difference between detectors 121 and 120 to determine the sizes and number of items ejected by ejector 128. The computer 146 provides the size and number of detected particles in each bin 130, 132 and 134. This data allows the threshold settings of the detectors to be set for higher purity and lower product loss, and it provides a measure of the sorting efficiency of the device 100.

In alternate embodiments, a system of processors (not shown) may be used. The microprocessors, or system of processors process the measurements and send signals to the first sized ejector 126, and second sized ejector 128, respectively, that deflect appropriately sized regions of REE into bins 130, 132, and 134. The computer 146 uses the detected signals to measure the number and size of each detected region in the three bins 130, 132 and 134. In the same manner that the screens are used above, within bin 130 is a first screen 136, and within bin 132 is a second screen 138, each having openings 140 sized to recover small sizes. Still referring to FIG. 4, a set of three openings is in the collimator 104 housing near the x-ray tube 102 and a second set of three openings is in the collimator 104 housing at the base which holds the ejectors 126 and 128. These openings are all parts of the collimator 104, and x-ray beams 114, 116, 117 are shown to pass through them.

Figure 5A:
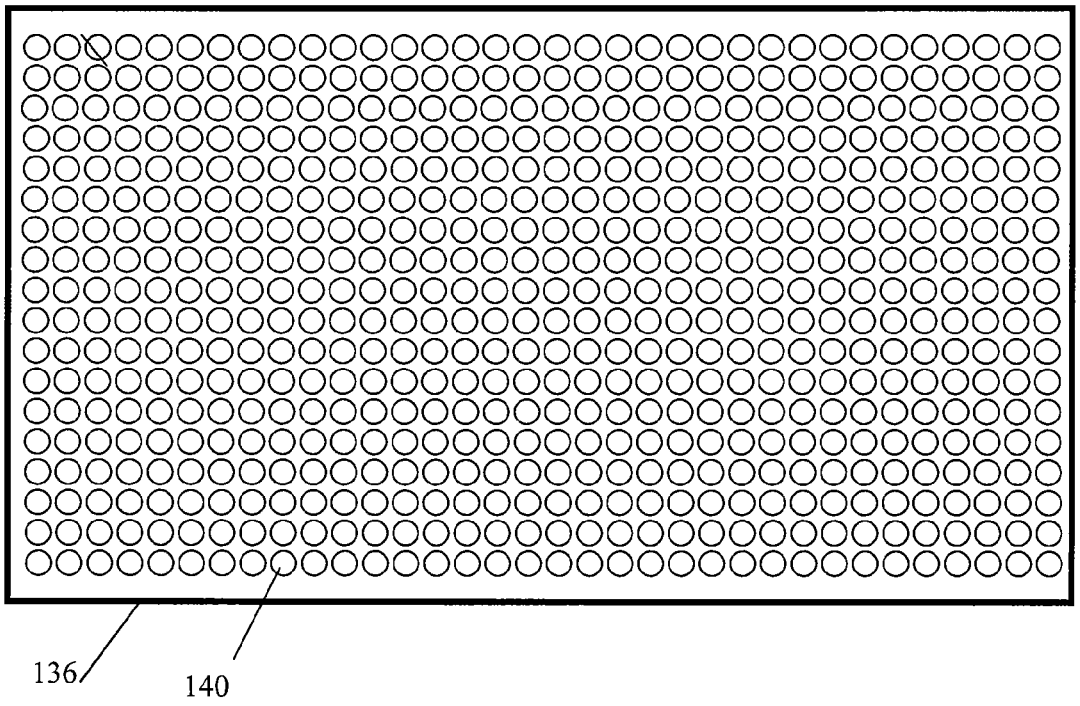
FIG. 5A is a top plan view of a first screen for use with the sorting devices of FIGS. 1-4.
Figure 5B:
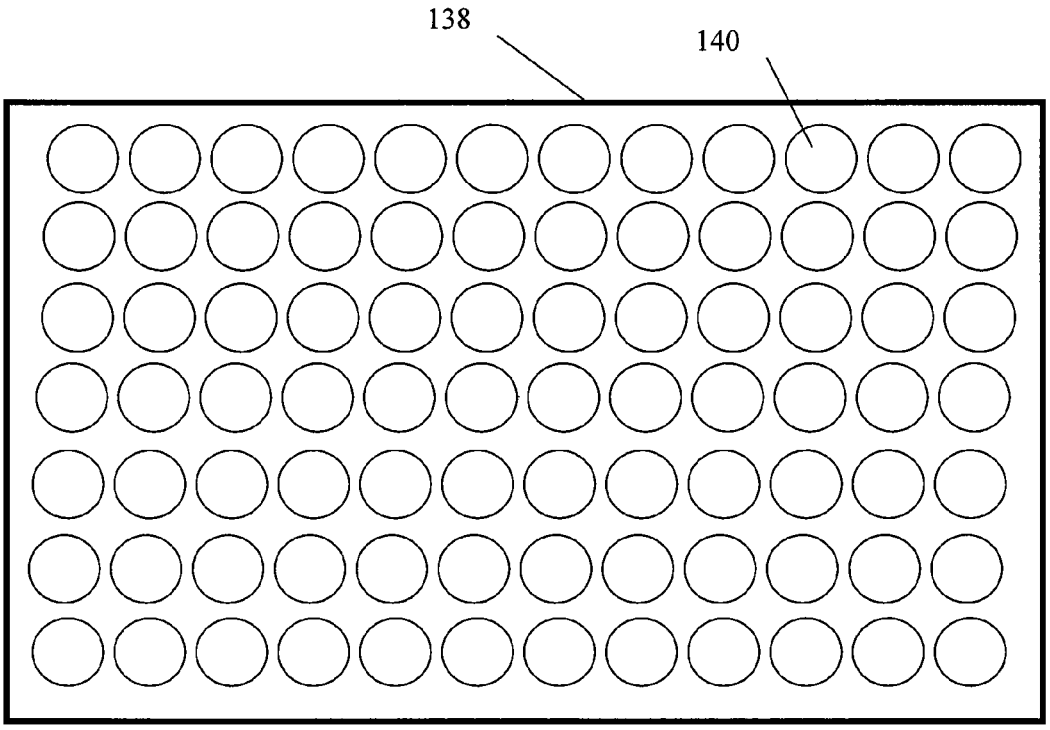
FIG. 5B is a top plan view of a second screen for use with the sorting devices of FIGS. 1-4.

FIGS. 5A-5B show schematic diagrams of embodiments of the first screen 136 and the second screen 138 used in connection with the coal sorting devices 100, 200, 300, 400 described above. FIG. 5A shows a screen 136 with smaller openings 140, which allow coal fines to pass therethrough. The screen 136 with the smaller openings 140 thereby recovers the fines ejected with the smaller regions and reduces product loss. FIG. 5B shows a screen 138 having larger openings 140 that allow smaller rock and ejected coal to pass therethrough and be returned to the sample stream 108 for further separation.

Figure 6:
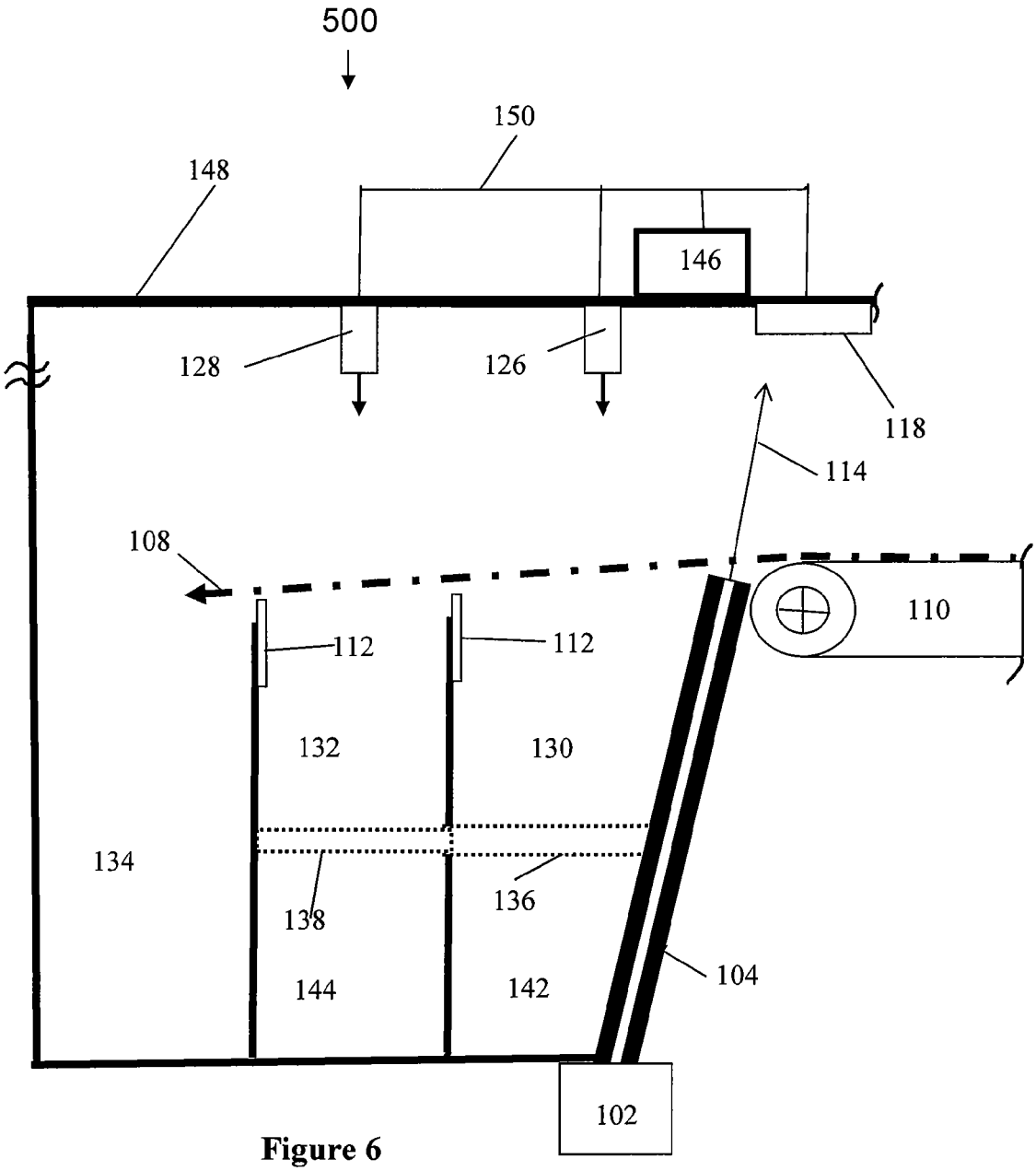
FIG. 6 is a side elevational view of an alternative exemplary coal sorting device for processing concentrated REE.

Referring now to FIG. 6, another exemplary coal sorting device 500 is shown comprising a conveyor belt 110 for transporting a waste coal stream 108 into a path between an x-ray source 102 attached to a first collimator 104 located beneath the sample stream 108, and a first x-ray detector 118 located above the sample stream 108 to receive the collimated x-rays. Also shown are the two sizes of ejectors 126 and 128 for separating the waste coal stream 108 into the areas shown. All of the ejectors are controlled by a single microprocessor 122. In sum, a dual ejector system with single collimated x-ray beam fan perpendicular to and under the sample stream is shown.

In the illustrated embodiment, the single x-ray detector 118 operates both a first sized ejector 126 and a second sized ejector 128. Shown therein is an x-ray source 102 and first collimator 104 located under a sample stream 108 flying off the conveyor 110 and clearing splitter plates 112. The first collimator 104 produces an x-ray fan 114 that strikes a first x-ray detector 118 which measures the absorption by the sample stream 108. The first x-ray detector 118 sends signals to the first microprocessor 122, which is at the same location as the detector 118, and which controls the first-sized ejectors 126 and the second-sized ejectors 128 to deflect selected objects in the sample stream 108 into bins 130 and 132, respectively. Also shown are communication connections 150 and a support structure 148 to which detectors 118, ejectors 126, 128, or the like, may be attached. Specifically, the first microprocessor 122 selects for ejection of large regions in the sample stream 108, and the first sized ejector 126 deflects the selected items into bin 130 where they strike the first screen 136, which as openings 140 that allow undersized items to pass into bin 142 where they can be returned to the conveyor 110. Also, the first microprocessor 122 selects smaller regions for ejection and sends a signal to the second sized ejector 128, which deflects said regions into bin 132 and onto a second screen 138 with openings 140 sized to recover fines. The fine material is collected in bin 144 and can be transferred to the sorted fines bin 134.

An alternate to the embodiment shown in FIG. 6 could combine the multiple x-ray beams 114, 116 and 117 of FIG. 4 into a single x-ray beam so that only a single x-ray beam 114 exists. Similarly, an alternate embodiment could combine the multiple detectors 118, 120 and 121 into a single detector array, such as 118, all connected through a single processor to ejectors 126 and 128 (which remain separated as shown in FIG. 4) to eject regions of various and selected sizes into separated bins 130, 132 or 134 as appropriate.

Figure 7:
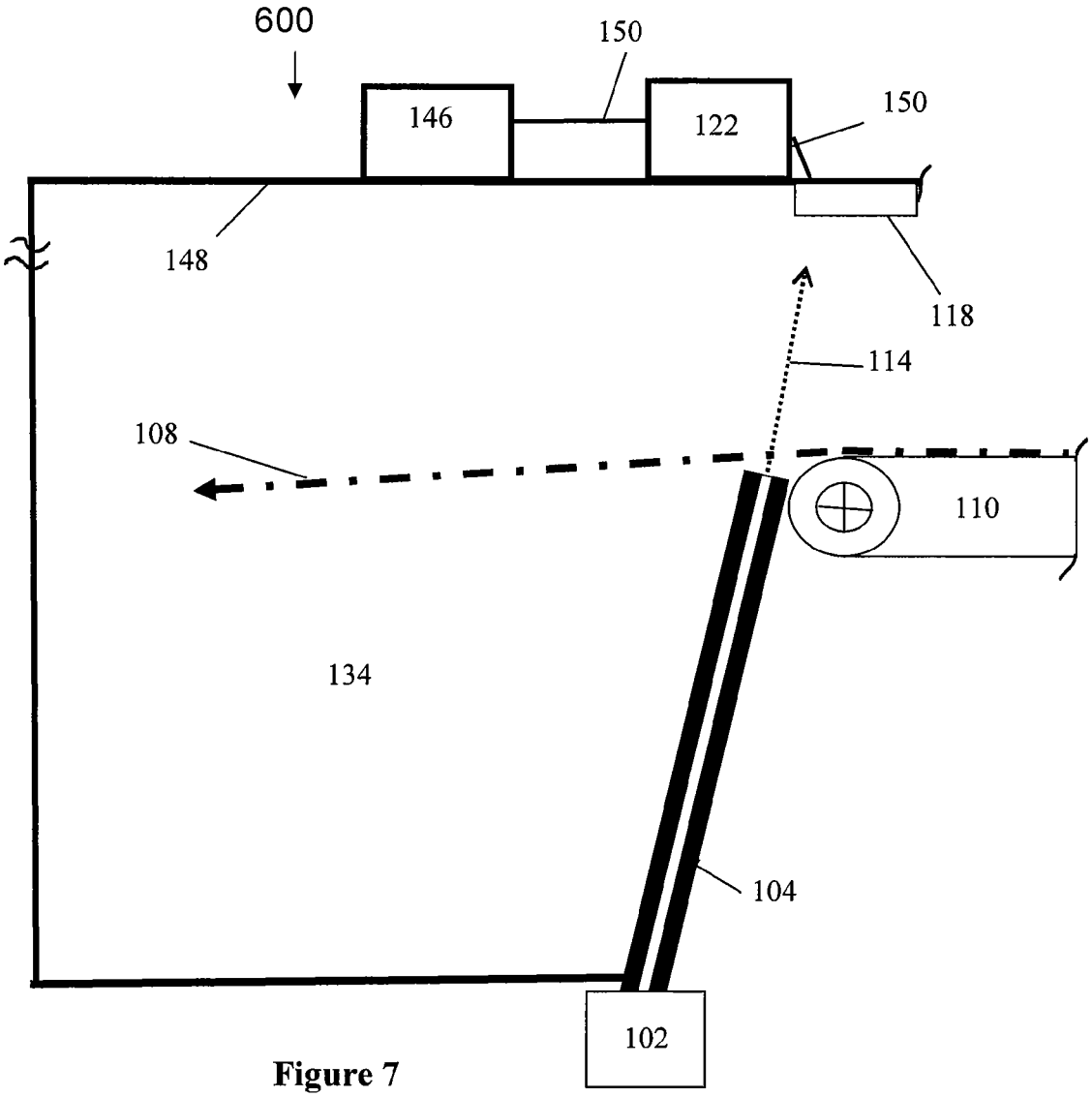
FIG. 7 is a side elevational view of an alternative exemplary coal sorting device for processing concentrated REE.

FIG. 7 shows a schematic diagram of a side view of an exemplary alternative coal sorting device 600 for inspecting a sample, as disclosed herein. The device 600 comprises a conveyor belt 110 for transporting coal into a path between an x-ray source 102 attached to a first collimator 104 located beneath the sample stream 108, and a first x-ray detector 118 located above the sample stream 108 to receive the collimated x-rays. The detector 118 sends signals to a microprocessor 122, which then transmits data to a monitor. The purpose of this embodiment is to inspect the amount of REE in a sample without sorting.

In the illustrated embodiment, an x-ray source 102 and first collimator 104 are located under a sample stream 108 flying off conveyor 110. The first collimator 104 produces x-ray fans 114 that strike a first x-ray detector 118 which measure the absorption by the sample stream 108. The first x-ray detector 118 sends signals to the first microprocessor 122 which transmit to computer 146 the sizes and number of items detected by the detector 118. The sample stream is collected in bin 134. As used herein, in certain embodiments, a bin 130, 132, 134 (FIG. 6) may also allow for placement on a conveyor belt. In this embodiment, it may be desired to collect the sample stream 108 on another conveyor.

Figure 8:
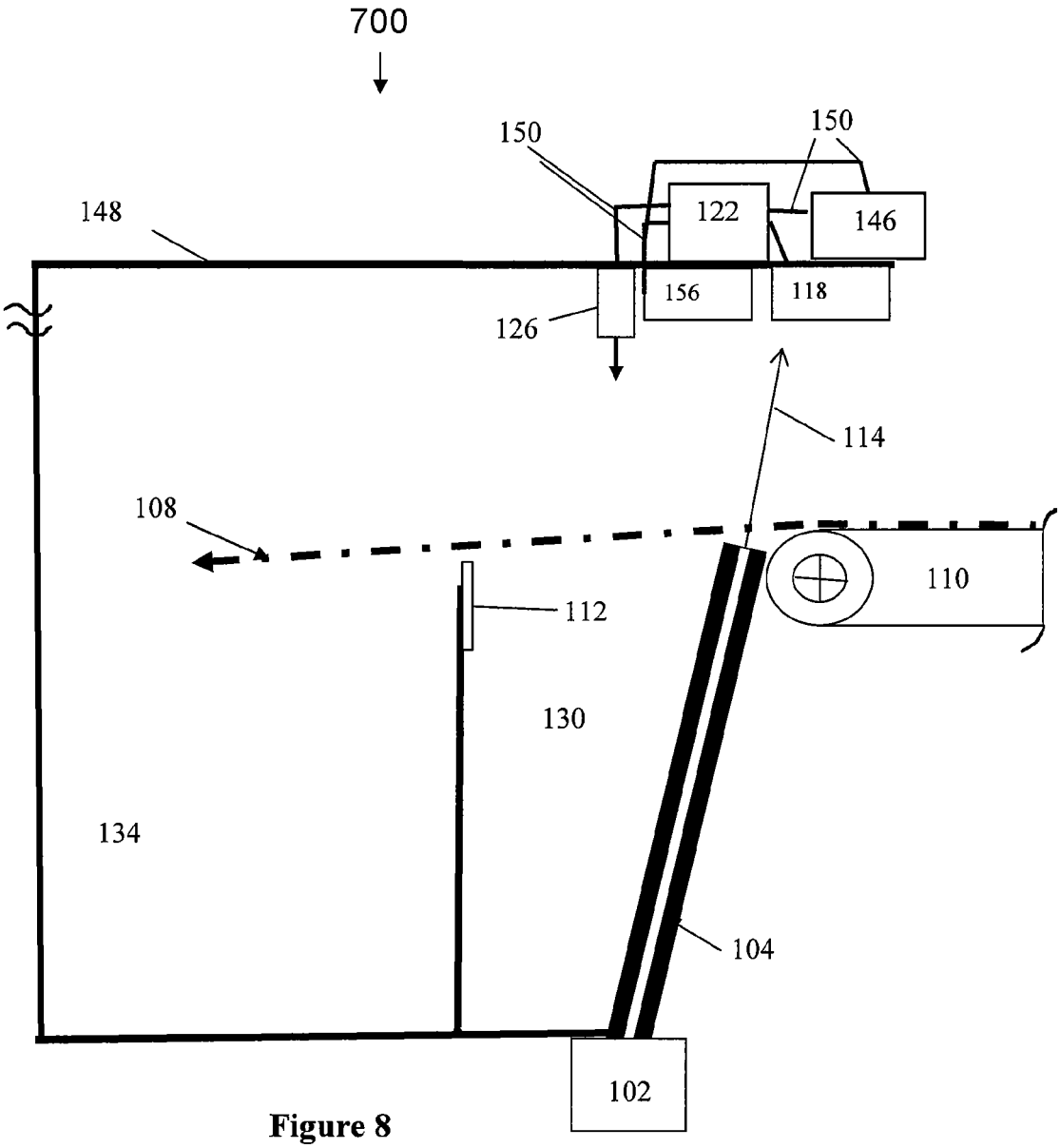
FIG. 8 is a side elevational view of an alternative exemplary coal sorting device for processing concentrated REE.

FIG. 8 shows another exemplary coal sorting device 700 comprising a conveyor belt 110 for transporting a waste coal stream 108 into a path between an x-ray source 102 attached to a first collimator 104, located beneath the waste coal stream 108, and a first x-ray detector 118, located above the waste coal stream 108, to receive the collimated x-rays. As will be discussed in more detail below, a 3D infrared imager 156 tracks the position and motion of individual pieces of the stream 108 as they pass beneath the detector 118. Also shown is a computer 146 and ejector system 126 for separating the waste coal into the areas shown. The detector 118 and the 3D infrared imager 156 send signals to the computer 146, which then sends signals to the ejector system 126. The purpose of this embodiment is to concentrate regions with greater REE content with greater separation efficiency, higher speed, and/or lower cost.

FIG. 9 shows the linear absorption coefficients and densities from the National Institute of Standards and Technology (NIST) for iron pyrite (FeS), coal, and silicon dioxide (SiO2) over a range of x-ray energies. FIG. 9A shows the mass absorption coefficients and densities from NIST for REE and carbon or graphite. Note that coal is a mixture of carbon and hydrocarbons, and there is no NIST "standard" for coal. Accordingly, the x-ray absorption coefficients of coal are the NIST data for graphite corrected for coal density of 1.2 grams per cubic centimeter (g/cc). As shown elsewhere herein, the absorption by coal is much less than the absorption of pyrite in silicates for 8 to 20 kilo electron volts (KeV) x-rays. The absorption for coal is also much less than REE. The information in FIGS. 9 and 9A illustrates how a material can be differentiated from other materials. For example, it is calculated that use of x-ray energy at a level of 15 KeV results in a 56.6% transmission through coal having a thickness of 1 cm, while contaminants having a thickness of only 1 mm have reduced transmission percentages of 0% (for FeS), and 20.5% (for $SiO_2$). By way of a second example, it is calculated that use of x-rays at an energy level of 20 KeV (for which coal having a thickness of 1 cm) has a transmission percentage of 73.2%, as compared to contaminants such as FeS and $SiO_2$, which have transmission percentages of 0% and 50%, respectively.

In some embodiments, the range of x-ray energies used is dependent upon the thickness of the sample stream 108. For instance, the range of x-ray energies may be from about 6 KeV to about 100 KeV. In other embodiments, the x-ray energies may be in the range of from about 8 KeV to about 20 KeV. In still other embodiments, the range of x-ray energies may be from about 50 KeV to about 100 KeV. In still other embodiments, the range of x-ray energies is above the absorption edge of the ejected element. Various devices may be appropriate to supply the x-ray energies and x-ray detectors used in the methods disclosed herein. In certain embodiments of the present invention, such a device may be the TRUSORT machine, second generation, commercially available from National Recovery Technologies, LLC of Nashville, Tenn. In other embodiments, an appropriate x-ray device is available from Commodas Mining GmbH at Feldstrasse 128, 22880 Wedel, Hamburg, Germany, and is called the COMMODAS ULTRASORT. It uses dual-energy detection algorithms similar to airport baggage scanners. In still other embodiments, an appropriate x-ray sensing device may be model DXRT which is commercially available from National Recovery Technologies, LLC of Nashville, Tenn. The x-ray sensing machine may be a dual energy device. In other embodiments, the x-ray device may be a broadband x-ray device such as the vinyl cycle model, which is commercially available from National Recovery Technologies, LLC of Nashville, Tenn.

II. EXEMPLARY METHOD FOR SORTING REE IN COAL WASTE MATERIALS

Figure 10:
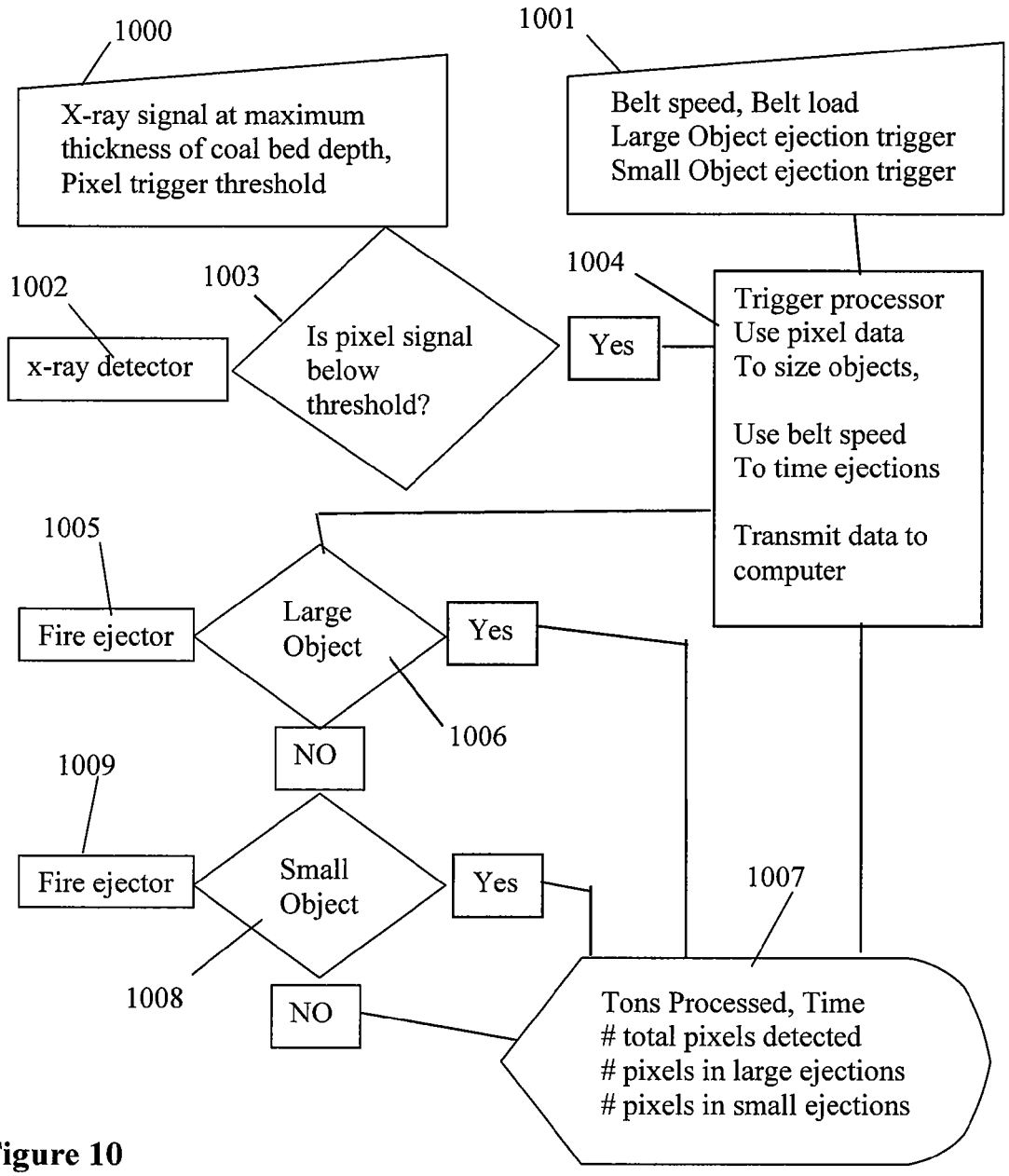
FIG. 10 is a flow diagram of an algorithm for sorting concentrated REE for use with the sorting devices of FIGS. 1-8.

FIG. 10 shows a flow diagram of an algorithm that uses the number of detector pixels that detect absorption of x-rays above and below the preset threshold. This algorithm uses the ratio of the total number of pixels during the recycle time of the x-ray detector array and the number of pixels reporting x-ray intensities below said threshold. Accordingly, in a certain embodiment, the pixel density is about 32/inch, and there are 1024 pixels readings while the coal waste stream 108 passes one inch over the detector. The coal waste stream 108 leaves the conveyor belt 110 at about 120 inches/sec, and the x-ray detector 118, 120 or 121 array is read and reset 32 times during one inch of travel of the stream. If the air ejectors 126 or 128 are one inch apart, each jet is controlled by the adjacent detectors, providing 32 intensity measurements to the computer 146 each time it reads and resets the detector array. The operator can set the detector to report readings that are less than a preset amount and indicate the presence of objects that absorb more than the average of the coal waste stream. This may identify material such as REE and rock in the sample stream that absorbs more than the coal material in the sample stream. The operator can also set the detector to report readings that are higher than a preset amount and indicate the presence of objects which absorb less than the average of the rock in the sample stream. This may then identify REE material from the rock in the sample stream that absorbs less than the rock material in the sample stream. Accordingly, the computer 146 may distinguish regions in the sample stream having middle-Z properties, which may typically include REE, from regions of coal having low-Z properties and from regions of rocks having high-Z properties to separate the higher-REE region from the rest of the sample stream.

The computer 146 can collect and analyze the data it collects and adjust the amount of ejected air. Larger items require more air than smaller items. The number of pixels reporting higher absorption is a measure of the size of the object and the amount of air that would be required to eject it. In the embodiment illustrated in FIG. 10, the operator inputs items 1000 and 1001, though these numbers might be derived in other ways as will occur to those skilled in the art. When in use, the x-ray detector 1002 reads a sample and determines whether the pixel signal is below and/or above threshold(s) 1003. If yes, then the computer 146 records information 1004. If a large object 1006 is detected, then a large air blast is provided by firing ejector 1005, and further information 1007 is stored. If a small object 1008 is detected, then a small air blast is provided by firing ejector 1009, and further information 1007 is stored.

In certain embodiments of the method, the detector threshold can be defined as a percentage (for example 80%) of the signal voltage from the thickest regions of the sample coal waste stream, without any inclusions of contaminants. The ejection threshold is then set as a percentage of pixel readings during the measurement cycle that have signals less than the detector threshold. The number of pixel signals with levels less than the threshold sets the minimum size of the ejected contaminate. For example, a detector with 25 pixels/cm can detect 0.4 mm objects. Ejecting on a single low pixel reading could reduce contaminates to 100 ppm, but the resulting the product loss would make this impurity level impractical. While ejection on the basis of a single pixel may be useful for extracting gold from base rock, a more typical threshold for a coal waste stream could be 250 pixels with low signals out of the typical 625 pixel signals per square cm of the sample.

In some embodiments, the use of dual-energy detectors permits determination of relative composition independent of coal thickness. In some embodiments, a complex pattern of matching size measurements of the coal waste stream is not needed, although it may be preferred that the pieces of the sample have sizes less than the average bed depth of the coal waste stream sample. Stated another way, the methods disclosed herein operate to identify materials by differences in x-ray absorption and reliably provide signals to rapid ejection mechanisms.

With regard to determining an ejection threshold, it should be noted that ejection is just one of several appropriate methods of physically separating pieces of the sample. In some embodiments, separation may occur by use of an array of air ejectors, as further described herein. In still other embodiments, separation may occur by pushing, moving, or otherwise thrusting a piece of sample that has reached an ejection threshold to physically separate it from a piece of sample that has not reached the ejection threshold. Such pushing or moving may occur by use of fast-acting pistons, mechanical levers, or flippers. One of ordinary skill in the art is familiar with various arms, hydraulics, and the like that may be used to physically move a piece of sample that has reached the ejection threshold.

As described herein, some embodiments have recordable devices, such as microprocessors, controllers, computers, or the like, in order to allow the machines to make determinations and perform functions. One of ordinary skill in the art is familiar with adjusting, manipulating, or programming such devices in order to achieve the methods set forth herein. By way of example, the DXRT model commercially available from National Recovery Technologies, LLC of Nashville, Tenn., is programmable such that ejection thresholds may be set. In this example, the DXRT machine calculates position and timing information for arrival of the piece of sample at the air ejection array needed to accurately energize downstream ejector mechanisms in the air ejection array and issues the necessary commands at the right time to energize the appropriate ejectors to eject the piece of sample having a contaminant from the flow of other pieces of sample. Accordingly, pieces of sample having sufficiently high-percent transmissions are not ejected by the air ejection array. In alternate embodiments, the machine may be set such that the opposite is true. That is, samples having sufficiently high-percent transmissions are ejected and lower transmission absorption pieces of sample are not ejected. Those of ordinary skill in the art recognize that such alterations to the methods disclosed herein may be performed.

One of ordinary skill in the art is familiar with the manner of operationally connecting components in detection systems as disclosed herein. All such wires, cables, and the like, needed for such operational connectivity are well known in the art and generally commercially available. Regarding each component of the present invention disclosed herein, operational connectivity includes any connections necessary for power, data or information transfer, or the like, for the operation of the specific device. One of ordinary skill in the art is familiar with such types of connections.

III. USE OF INFRARED 3D IMAGING WITH A COAL SORTER

Infrared 3D imaging may be used to enhance the efficiency of the sorter 100, 200, 300, 400, 500, 600, 700. By way of introduction, adding infrared 3D imaging to electromagnetic radiation material separation can greatly improve the separation efficiency and the throughput of the separation process. An embodiment of the present invention includes an infrared 3D imager 156 to track the position of each discrete piece of material being separated from the time it is identified using an electromagnetic radiation source 102 and detector 118 to the time it has arrived on the correct chute or conveyor. By including the 3D imager 156 with the coal waste stream sorter disclosed herein, the system can verify correct separation of pieces, which depend upon the pieces maintaining predictable vectors of motion. Such systems can also measure the thickness of every piece being separated. This allows accurate separation decisions on a wide range of materials using measurements of single-energy x-rays, materials which before would have required the more costly and complicated measurement of x-rays of multiple energies.

Referring back to FIG. 8, there is shown an embodiment of the device 800 including an infrared 3D imager 156. As shown therein, the infrared 3D imager 156 is positioned above the end of the conveyor 110 on which the sample stream 108 travels. The infrared 3D imager 156 is operationally connected to computer 146 by communication connections 150 so that information generated by the infrared 3D imager 156 is provided to the computer 146. That information includes geometry and motion information, such as position, velocity, direction of travel, acceleration, rotation, thickness, size, shape, and orientation of pieces both before and after ejection. The computer 146 then controls the ejectors 126, as disclosed above, so that such additional information (i.e., shape, thickness, rotation, acceleration, velocity, direction of travel, etc.) is used to more efficiently separate the sample. The computer 146 is also receiving information and data from x-ray detector 118 through microprocessor 122 so that the x-ray detection information and 3D imager information are used in combination. In certain embodiments, the infrared 3D imager 156 is used with known electromagnetic radiation sorters. In other embodiments, the infrared 3D imager 156 is used with non-collimated x-ray beams.

Infrared 3D imagers 156 are known in the art and readily commercially available. For example, an infrared 3D imager 156 may be purchased from Primesense in Tel Aviv, Israel. By way of background, an infrared 3D imager 156 illuminates the pieces of sample with continuously projected, infrared structured light. By reading the infrared reflections with a CMOS sensor and calculating a dynamic, 3D representation of the material from the CMOS data using parallel computational logic, it may report the position, velocity, direction of travel, acceleration, rotation, size, shape, orientation and thickness of the pieces of material in the 3D representation or any combination of these parameters, as well as the results of calculations based on those parameters. Such information can improve the throughput and/or improve the separation efficiency and/or lower the operating cost of the separation process.

It is an unexpected benefit to have this further information. These position, shape and size measurements mean many implementations of the present disclosure can operate at a higher capacity, as the sample pieces can be in motion on vectors distinct from the motion vector of the conveyor. Further, the conveyor 110 density can be higher than normal as it is not as necessary to avoid collisions between the sample pieces. The size and shape measurements mean the power requirements of the separation process can be less as the intensity of the physical separation can be varied according to the size and shape of the sample piece. The thickness measurements mean the systems can report the thickness of the sample pieces at the point of identification to allow x-rays of a single energy to provide more information than is currently possible by simply measuring the x-ray absorption alone. In sum, all of these measurements can be made from before or at the point the sample pieces are examined by electromagnetic radiation to the time the sample pieces have definitely and finally passed through the sorter system and are in the collection bins, or on the chutes or conveyors for the rejected fraction or the collection bins, chutes or conveyors for the accepted fraction.

In some embodiments, when the infrared 3D imager 156 is tracking individual sample pieces, the following algorithm may be put in use:

1. At the point where the sorter system makes the determination to keep or reject, with "reject" defined in this example as the decision to employ the physical separation technology, e.g. air ejectors or other means, the shape, size and position of every sample piece designated for rejection is recorded.

2. The exemplary system tracks, in real time, sampling as often as is practical given the speed of the electronics of the day and given the speed of the sample material passing through the system, the position of the sample pieces designated for rejection as they moved towards the physical separation technology. The size, shape and previous position of the sample pieces uniquely identify each sample piece. In an alternate embodiment, the present system may calculate the speed, direction of travel, acceleration, or rotation of the sample pieces.

3. At the moment a sample piece designated for rejection arrives at the physical separation technology, the present system triggers, or causes to be triggered, the physical separation technology at the optimum position given the position of the sample piece. In alternate embodiments, this decision could also be informed by the shape or size of the sample piece or the motion of the sample piece.

4. Because the size of each sample piece is mapped, the intensity of the physical separation according may vary according to the size, shape, or orientation of the sample piece. For example, in the case of pneumatic separation, big sample pieces to be deflected would get more air.

5. The position of each sample piece marked for rejection continues to be tracked until it crosses a threshold marking it as definitely and finally having landed in a collection bin, or on the chute or conveyor carrying the rejected fraction, or another threshold marking it as definitely and finally being mis-classified and landing in a collection bin, or on the chute or conveyor carrying the accepted fraction. Optionally, data on the incidence of misclassification may be recorded and maintained. Also, optionally, such data may be used to vary, or cause to be varied, the speed of the conveyor feeding the sorter system or the intensity of the physical separation technology, or other appropriate parameters in an effort to minimize misclassification.

6. In the cases when the sample pieces marked for rejection missed the intended bins or chutes and bounced back into the mixed sample stream, the present system maintains surveillance of the sample piece from steps 2-5 until the sample piece crosses a threshold marking it as definitely and finally out of the surveillance.

In some embodiments, such as in the case of estimating the thickness of the individual sample pieces at the point of identification to allow x-rays of a single energy to provide more information, the following algorithm is of use:

1. Prior to operation, the infrared 3D imager 156 is calibrated with objects of known thickness at the point of x-ray identification. This calibration informs the infrared 3D imager 156 with the data required to report an accurate measurement of the object's thickness.

2. At the point the present system makes the identification with single-energy x-rays, the infrared 3D imager 156 reports the thickness of the object at the point on the object through which the x-rays pass. This thickness datum combined with the datum of the x-ray absorption from the x-ray detector is used to make, or cause to be made, the decision to accept or reject the sample piece.

3. Optionally, as the sample pieces move towards the physical separation technology, the infrared 3D imager 156 re-samples the thickness estimate and revisits the decision to accept or reject. This step corrects for inaccuracy caused by an estimate of thickness from a single angle. In this case, all objects would be tracked through the infrared 3D imager 156, or at least all about which there had been some accept/reject ambiguity, and not just those marked for rejection.

The two algorithms are not exclusive. Both can and likely would be simultaneously used in many embodiments of the present invention. A person of ordinary skill in the art would, with software based on the above algorithms, be enabled to make an embodiment of this invention with a 30 Hz sampling rate using Microsoft's Kinect Controller for Xbox, which is readily commercially available. As known to one of ordinary skill in the art, an embodiment of the present invention with higher sampling rates and a higher-resolution pattern of structured infrared light could be made with software based on the above algorithms and Primesense's PS1080 system on a chip, their PrimeSensor Reference Design and their NITE middleware software, all of which are readily commercially available.

IV. EXAMPLES

Example 1: Multi-Fractional Sorting of Regions Having Higher Concentrations of REE with Multiple Collimated X-Ray Beams As shown in FIG. 1, a waste coal stream is placed on a fast conveyor 110 that gives the stream sufficient velocity to clear the splitter plates 112 and land in bin 134. The first x-ray detector 118 measures the absorption of the waste coal stream. Again, the detectors may be located at the end of the conveyor 110 as shown in FIG. 1 or located under the belt of the conveyor 110 (not shown). The absorption signals are sent from the first detector 118 to the first microprocessor 122 which selects larger regions having higher concentrations of REE and signals first sized ejector 126 to remove the selected regions from the coal stream. The first sized ejector 126 has sufficient force to deflect heavy rocks into bin 130. The forceful ejection will also eject any materials adjacent to the heavy rock and screen 136 has 0.5-inch openings 140 that allow smaller pieces of material to pass into bin 142. The material in bin 142 can be returned to conveyor 110. The remaining smaller regions having higher concentrations of REE pass by the second detector 120, which measures absorption of the x-ray beam 116 by the sample. The second detector 120 is operationally connected to the second microprocessor 124, which may be set to select smaller regions having higher concentrations of REE and signal the second sized ejector 128 to deflect such regions into bin 132. The deflection of smaller regions having higher concentrations of REE does not require the force needed to deflect the more massive larger regions having higher concentrations of REE, and the use of smaller, more numerous ejectors limit the amount of material inadvertently ejected with the smaller regions. The smaller region deflected into bin 132 falls onto screen 138, which has 0.25-inch openings 140 that allow passage of the smaller-sized items into bin 144, where such smaller items can be mixed back in with the waste coal stream in bin 134. Obviously, sample that is not deflected has the velocity and projection to land in bin 134. While the preferred embodiment uses multiple x-ray beams from the same x-ray tube 102, in alternate embodiments, multiple x-ray beams can also be obtained by the use of two or more x-ray tubes 102.

Example 2: Multi-Fractional Sorting of Regions Having Higher Concentrations of REE with a Single Collimated X-Ray Beam As shown in FIG. 6, the coal sorting device 500 combines certain features of the previously described embodiments herein to take advantage of the ability of a fine pitch x-ray detector to simultaneously measure absorption of x-rays passing through both large regions and small regions of the waste coal stream. That is, a single first collimator 104 provides an x-ray fan 114 to the first x-ray detector 118. The first x-ray detector 118 provides signals to the microprocessor 122 (not shown, but at same location as the detector 118). The first-sized ejectors 126 and the second-sized ejectors 128 are not combined and remain positioned as shown with one downstream from the other. The x-ray fan 114 passes through the mineral or coal stream 108 and is detected and measured by detector 118. The measurements are processed by microprocessor 122, which runs an algorithm (not shown) that analyzes the measurements and distinguishes larger regions having higher concentrations of REE from smaller regions having higher concentrations of REE, while distinguishing both from the surrounding coal bed. Microprocessor 122 then signals ejectors 126 or 128 as appropriate to eject smaller regions having higher concentrations of REE into bins 132 and larger regions having higher concentrations of REE into bin 130. In effect this embodiment utilizes a single x-ray beam analysis system connected with a dual ejection system.

Example 3: Multi-Fractional Sorting with a Measurement of Size and Number of Detected Objects in Product and Reject Bins FIG. 4 shows a device 400 with three x-ray beams 114, 116 and 117 from the same x-ray tube 102 that sorts large- and small-sized regions into separate collection bins and uses the data from the three x-ray detectors 118, 120 and 121 to measure the number and size of detected objects in the product and reject bins. This embodiment provides the machine operator with a running estimate of product loss and impurity. It also measures the ejection efficiency with the ratio of ejector triggers to items removed from the coal stream. The ejection efficiency data allows the machine operator to adjust the air amount to eject the regions with minimal carryover of the waste coal stream.

Example 4: Inspection of Regions Having Higher Concentrations of REE without Sorting As shown in FIG. 7, the device 600 operates as an inspector without sorting. Specifically, the microprocessor 122 uses the absorption data from first x-ray detector 118 to determine the number and sizes of regions having higher concentrations of REE in the waste coal sample and records this data in computer 146. Such information is useful to help determine the amount of concentrated REE regions in the waste coal sample.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is not to be limited to the details of structure and operation shown and described in the specification and drawings.

What is claimed is:

1. A method of sorting materials, comprising the steps of:

directing a sample of coal waste having first and second regions in a downstream direction;

receiving, by a first detector, a first collimated x-ray beam from at least one x-ray source that has been passed through the first region;

measuring a first x-ray absorption characteristic of the first region based on the received first collimated x-ray beam;

in response to determining that the first region has a first concentration of rare earth elements based on the measured first x-ray absorption characteristic, physically separating the first region from the second region;

receiving, by a second detector located downstream relative to the first detector, a second collimated x-ray beam from the at least one x-ray source, where the second collimated x-ray beam has been passed through the second region;

measuring a second x-ray absorption characteristic of the second region based on the received second collimated x-ray beam; and in response to determining that the second region has a second concentration of rare earth elements based on the measured second x-ray absorption characteristic, physically separating the second region from a remainder of the sample.

2. The method of claim 1, wherein the step of determining that the first region has a first concentration of rare earth elements comprises determining whether the measured first x-ray absorption characteristic is between (a) an x-ray absorption characteristic of a coal material and (b) an x-ray absorption characteristic of a rock material.

3. The method of claim 1, wherein the step of determining that the first region has a first concentration of rare earth elements comprises determining that the first region has a specific gravity between about 1.8 and about 2.0.

4. The method of claim 1, wherein the step of physically separating the first region from the second region comprises sorting the first region of the sample from the second region by use of an ejector.

5. The method of claim 4, wherein the ejector is an air blast.

6. The method of claim 1, further comprising identifying a second region in the sample having higher concentrations of rare earth elements than other regions in the sample wherein:

the step of determining that the second region has a second concentration of rare earth elements comprises determining that the second concentration is higher than the first concentration and the second region is smaller than the first region.

7. The method of claim 1, further comprising determining identifying characteristics of the sample by use of an infrared 3D imager.

8. The method of claim 1, wherein the step of measuring a first x-ray absorption characteristic of the first region comprises measuring x-ray absorption at a plurality of energy levels.

9. A method of sorting materials, comprising the steps of:

directing a sample of coal waste in a downstream direction;

receiving, by at least one detector, at least one collimated x-ray beam from an x-ray source, where the x-ray beam has been passed through the sample of coal waste;

measuring at least one x-ray absorption characteristic of the sample based on the received at least one collimated x-ray beam;

identifying a first region and a second region in the sample having a concentration of rare earth elements based on the measured x-ray absorption characteristic, wherein the first region is larger than the second region; and sorting the first region from the sample by a first ejector at a first location and sorting the second region from the sample by a second ejector at a second location downstream relative to the first location.

10. The method of claim 9, wherein the first ejector is a first air blast, and wherein the second ejector is a second air blast that is smaller than the first air blast.

11. The method of claim 9, further comprising the steps of:

receiving the first region sorted by the first ejector in a first collection bin, and receiving the second region sorted by the second ejector in a second collection bin.

12. The method of claim 11, wherein the first and second collection bins are combined.

13. The method of claim 9, further comprising the steps of:

separating larger pieces from the sorted first region with a first screen defining a first plurality of openings so that smaller-sized objects may pass through the openings, and separating smaller pieces from the sorted second region with a second screen defining a second plurality of openings smaller than the first plurality of openings so that smaller objects may pass through the openings.

14. A multi-fractional coal sorting device, comprising:

a conveyor configured to direct a sample of coal waste in a downstream direction;

an x-ray source in a fixed position;

a first collimator attached to the x-ray source;

a first x-ray detector positioned to receive x-rays collimated by the first collimator, wherein the first x-ray detector is configured to measure at least one first x-ray absorption characteristic of the sample from the received x-rays collimated by the first collimator;

a first microprocessor operationally connected to the first x-ray detector, wherein the first microprocessor is configured to identify a first region in the sample having a first concentration of rare earth elements based on the measured first x-ray absorption characteristic;

a first sized ejector operationally connected to the first microprocessor and configured to eject the first region in the sample;

a second collimator attached to the x-ray source;

a second x-ray detector positioned downstream relative to the first x-ray detector to receive x-rays collimated by the second collimator, wherein the second x-ray detector is configured to measure at least one second x-ray absorption characteristic of the sample from the received x-rays collimated by the second collimator;

a second microprocessor operationally connected to the second x-ray detector, wherein the second microprocessor is configured to identify a second region in the sample having a second concentration of rare earth elements based on the measured second x-ray absorption characteristic, wherein the second region is smaller than the first region; and a second sized ejector operationally connected to the second microprocessor, wherein the second sized ejector is configured to eject the second region in the sample.

15. The device of claim 14, further comprising:

a first collection bin positioned to receive the first region of the sample ejected by the first sized ejector;

a second collection bin positioned to receive the second region of the sample ejected by the second sized ejector;

a first screen within the first collection bin, wherein the first screen defines a first plurality of openings such that smaller sized objects may pass therethrough; and a second screen within the second collection bin, wherein the second screen defines a second plurality of openings such that smaller sized objects may pass therethrough.

16. The device of claim 15, wherein the first collection bin and the second collection bin are combined.

17. The device of claim 14, further comprising a third collimator, a third x-ray detector, wherein the third x-ray detector is in a fixed position to receive x-rays collimated by the third collimator, wherein the third x-ray detector is configured to measure at least one third x-ray absorption characteristic of the sample from the received x-rays collimated by the third collimator, and a third microprocessor operationally connected to the third x-ray detector, wherein the third microprocessor is configured to identify a third region in the sample having a third concentration of rare earth elements based on the measured third x-ray absorption characteristic.

18. The device of claim 14, further comprising an infrared 3D imager positioned above a conveyor so that identifying characteristics of pieces of the sample on the conveyor are determined by the infrared 3D imager.

* * * * *